US010403957B2

(12) United States Patent
Wong

(10) Patent No.: US 10,403,957 B2
(45) Date of Patent: Sep. 3, 2019

(54) CAVITY FILTER

(71) Applicant: NANNING FUGUI PRECISION INDUSTRIAL CO., LTD., Nanning (CN)

(72) Inventor: Kwo-Jyr Wong, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 110 days.

(21) Appl. No.: 15/629,905

(22) Filed: Jun. 22, 2017

(65) Prior Publication Data

US 2018/0277920 A1 Sep. 27, 2018

(30) Foreign Application Priority Data

Mar. 23, 2017 (CN) ..... 1061 0 9773

(51) Int. Cl.

| | |
|---|---|
| ***H01P 7/06*** | (2006.01) |
| ***H01P 1/207*** | (2006.01) |
| ***H01P 1/202*** | (2006.01) |
| ***H01P 1/205*** | (2006.01) |
| ***H01P 1/208*** | (2006.01) |
| *H01P 7/04* | (2006.01) |

(52) U.S. Cl.

CPC ..... *H01P 7/06* (2013.01); *H01P 1/202* (2013.01); *H01P 1/207* (2013.01); *H01P 1/208* (2013.01); *H01P 1/2053* (2013.01); *H01P 7/04* (2013.01)

(58) Field of Classification Search

CPC ..... H01P 7/06; H01P 7/04; H01P 1/207
USPC ..... 333/206–209, 212
See application file for complete search history.

(56) References Cited

U.S. PATENT DOCUMENTS

2012/0235771 A1* 9/2012 Wong ..... H01P 7/04 333/203
2015/0061792 A1* 3/2015 Chun ..... H01P 1/208 333/202
2015/0116056 A1* 4/2015 Masuda ..... H03H 7/1708 333/185

FOREIGN PATENT DOCUMENTS

| | | | |
|---|---|---|---|
| CN | 1776958 | A | 5/2006 |
| CN | 201820870 | U | 5/2011 |
| CN | 103151586 | A | 6/2013 |
| CN | 104795615 | A | 7/2015 |
| CN | 205723886 | U | 11/2016 |
| CN | 205921058 | U | 2/2017 |

* cited by examiner

*Primary Examiner* — Rakesh B Patel
(74) *Attorney, Agent, or Firm* — ScienBiziP, P.C.

(57) ABSTRACT

A cavity filter includes a housing, the housing includes resonant cavity groups, each of the resonant cavity groups has two resonant cavities, a partitioning portions is provided between the two resonant cavities, and the partitioning portions is provided with an adjustment passage running through the two resonant cavities. A cover plate is mounted on the housing to cover the resonant cavity groups. A resonating assembly includes a resonant tube, a resonant cap connected with the resonant tube, and a resonant adjustment screw provided in the resonant tube. The resonant tube is disposed on the inner wall of the resonant cavities. The resonant cap is opposite the cover plate. A coupling adjustment assembly is used for reducing the magnetic coupling amount between the two resonant cavities and enhancing the electrical coupling amount between the two resonant cavities.

11 Claims, 7 Drawing Sheets

CAVITY FILTER

FIELD

The subject matter herein generally relates to the field of filters, and more particularly to a cavity filter.

BACKGROUND

The conventional cavity filter is provided with a coupling adjustment structure for adjusting the coupling frequency between the filter and the cavity, such as a resonant adjustment screw and a coupling adjustment screw. The resonant adjustment screw and the coupling adjustment screw are mostly mounted on the cover plate. In order to install the resonant adjustment screw and the coupling adjustment screw, the cover plate needs to have a certain thickness, which increases the overall size of the cavity filter. The installation of the resonant adjustment screw and the coupling adjustment screw cause the upper surface of the cover plate to be uneven, and the space of the cover plate is occupied. It is not convenient to use, and affects the appearance of the cavity filter.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. It will be appreciated that for simplicity and clarity of illustration, where appropriate, reference numerals have been repeated among the different figures to indicate corresponding or analogous elements.

DETAILED DESCRIPTION

Figure 1:
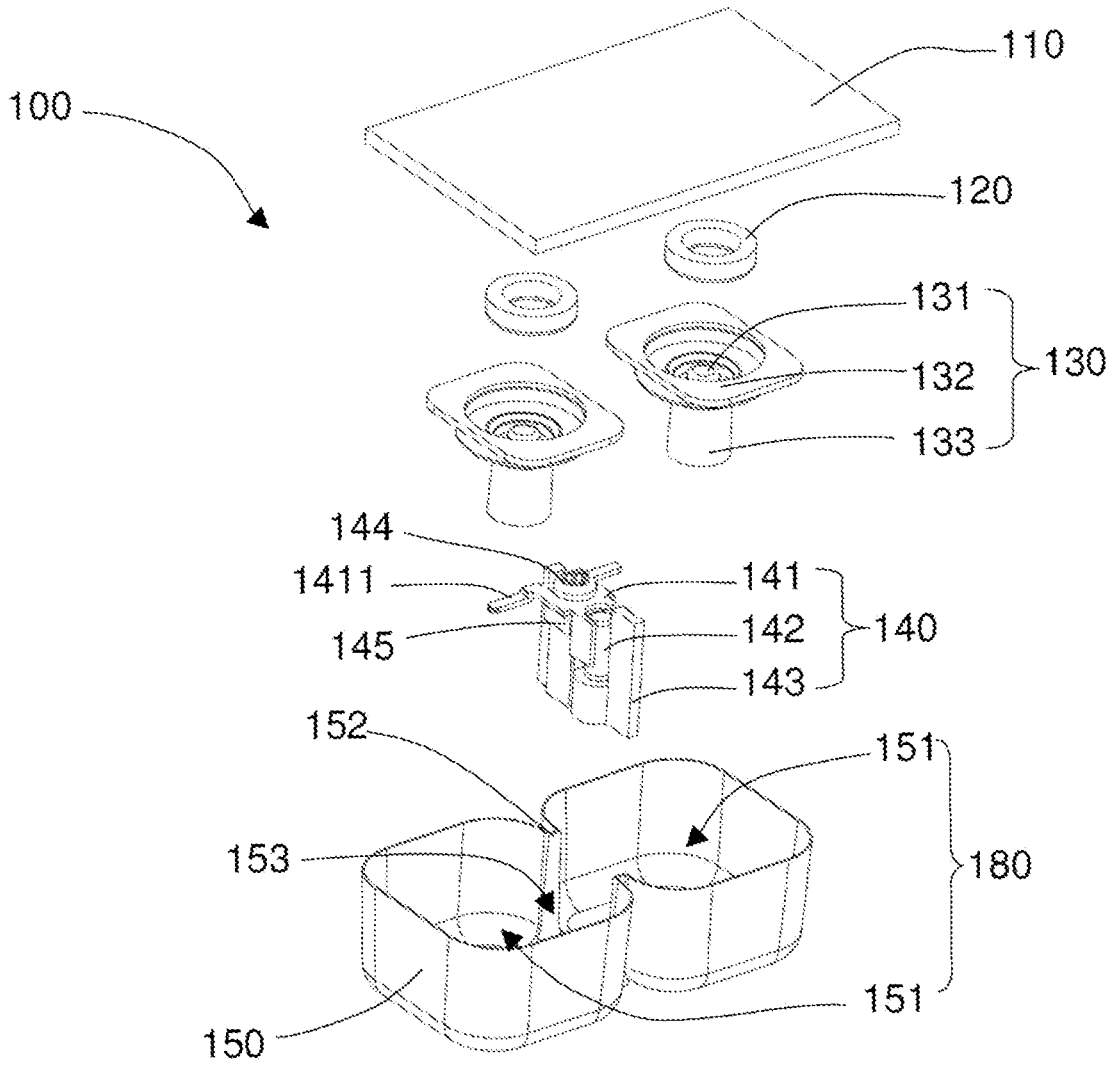
FIG. 1 is an exploded perspective view of an exemplary embodiment of a cavity filter.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "inside" indicates that at least a portion of a region is partially contained within a boundary formed by the object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 shows an exemplary embodiment of a cavity filter 100. The cavity filter 100 can include a cover plate 110, a capacitive loading ring 120, a resonating assembly 130, a coupling adjustment assembly 140 and a housing 150. The resonating assembly 130 includes a resonant adjustment screw 131, a resonant cap 132 and a resonant tube 133. The resonant cap 132 mounted on a bottom wall (see FIG. 2) is coiled around the resonant tube 133. The resonant adjustment screw 131 is connected to the resonant tube 133 by a threaded structure. The coupling adjustment assembly 140 includes an electrical coupling sheet 141, a coupling adjustment screw 142, and a partition wall 143. The electrical coupling sheet 141 is fastened to the partition wall 143 by a fastener 144 and has two symmetrical extension arms 1411. A gasket 145 is provided between the electrical coupling sheet 141 and the partition wall 143. The coupling adjustment screw 142 is threadedly engaged with the partition wall 143. The housing 150 includes two symmetrical resonant cavities 151 formed inside the housing 150, a partitioning portion 152 is provided between the two resonant cavities 151, and the partitioning portion 152 has an adjustment passage 153 for penetrating the two resonant cavities 152. The capacitive loading ring 120 is mounted on the cover plate 110 and facing to the resonant assembly 130. The cover plate 110 covers the housing 150 to enclose the resonant cavity 151.

Figure 2:
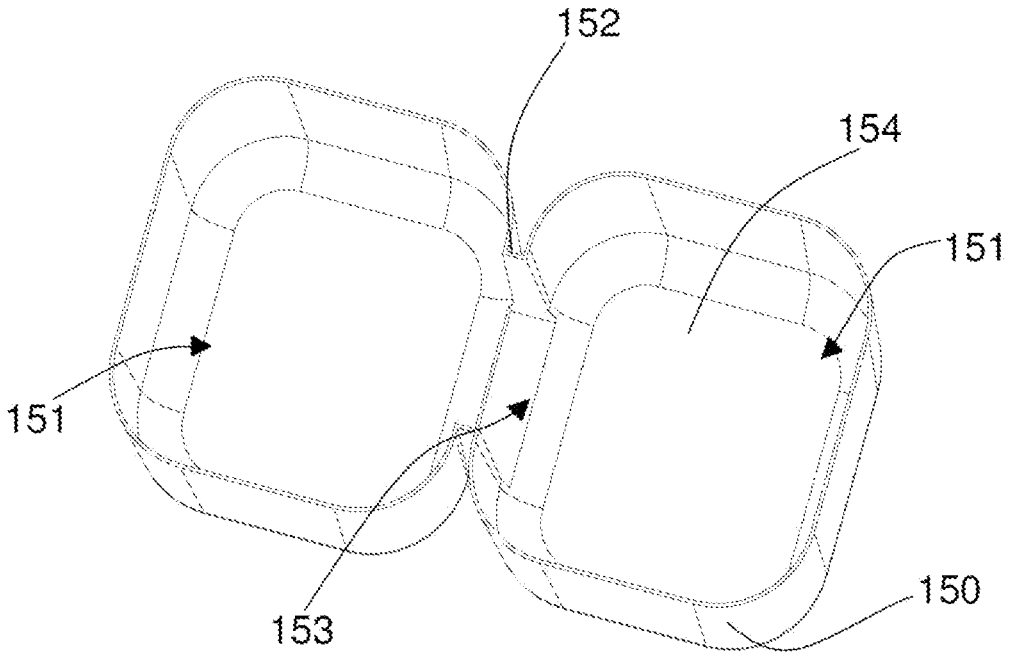
FIG. 2 is a perspective view of a shell of the cavity filter shown in FIG. 1.

Referring to FIGS. 1 and 2, in this exemplary embodiment, the housing 150 has a resonant cavity group 180 consists of two resonant cavities 151. In other embodiments, the housing 150 can be provided with a plurality of resonant cavity groups 180 parallel or perpendicular with each other. The resonant cavities 151 of the adjacent two resonant cavity groups 180 are not in communication.

The partition wall 143 has a lower portion resisted to the adjustment passage 153, two sides resisted to the partitioning portion 152 and a upper portion resisted to the inner side of the cover plate 110. In this exemplary embodiment, the resonant tube 133 is integrally formed with the bottom wall 154 of the housing 150. In other embodiments, the partition wall 143 can be welded to the bottom of the adjustment passage 153, the bottom of the resonant tube 133 can be welded to the bottom wall 154 of the housing 150.

The cover plate 110 and the housing 150 are connected by a screw (not shown). For example, in one embodiment, a fixing ear (not shown) can be drawn out from the housing 150, a threaded hole (not shown) and a positioning post (not shown) may be provided on the fixing ear. Correspondingly, a threaded hole (not shown) and a positioning hole (not shown) are provided at the corresponding positions of the cover plate 110. The cover plate 110 and the housing 150 are accurately aligned by the engagement of the positioning post with the positioning hole, and finally the screw is attached to the threaded holes of the fixing ear and the cover plate 110, thus the cover plate 110 is fixed to the housing 150.

In order to facilitate the installation and adjustment of the resonant adjustment screw 131 and the coupling adjustment screw 142, the resonant tube 133 and the partition wall 143 are provided with threaded holes (not shown). After the resonant tube 133 and the partition wall 143 are mounted on the housing 150, the threaded holes of the resonant tube 133 and the partition wall 143 are exposed to the bottom of the housing 150. The resonant adjustment screw 131 and the coupling adjustment screw 142 are screwed into the resonant tube 133 and the partition wall 143 from the bottom of the housing 150, respectively. In another exemplary embodiment, the position of the resonant tube 133 and the partition wall 143 provided at the bottom of the housing 150 have a recessed structure, and the threaded holes of the resonant tube 133 and the partition wall 143 are exposed in the recessed structure. As such, it is easy to install the resonant adjustment screw 131 and the coupling adjustment screw 142 on the resonant tube 133 and the partition wall 143.

Figure 3:
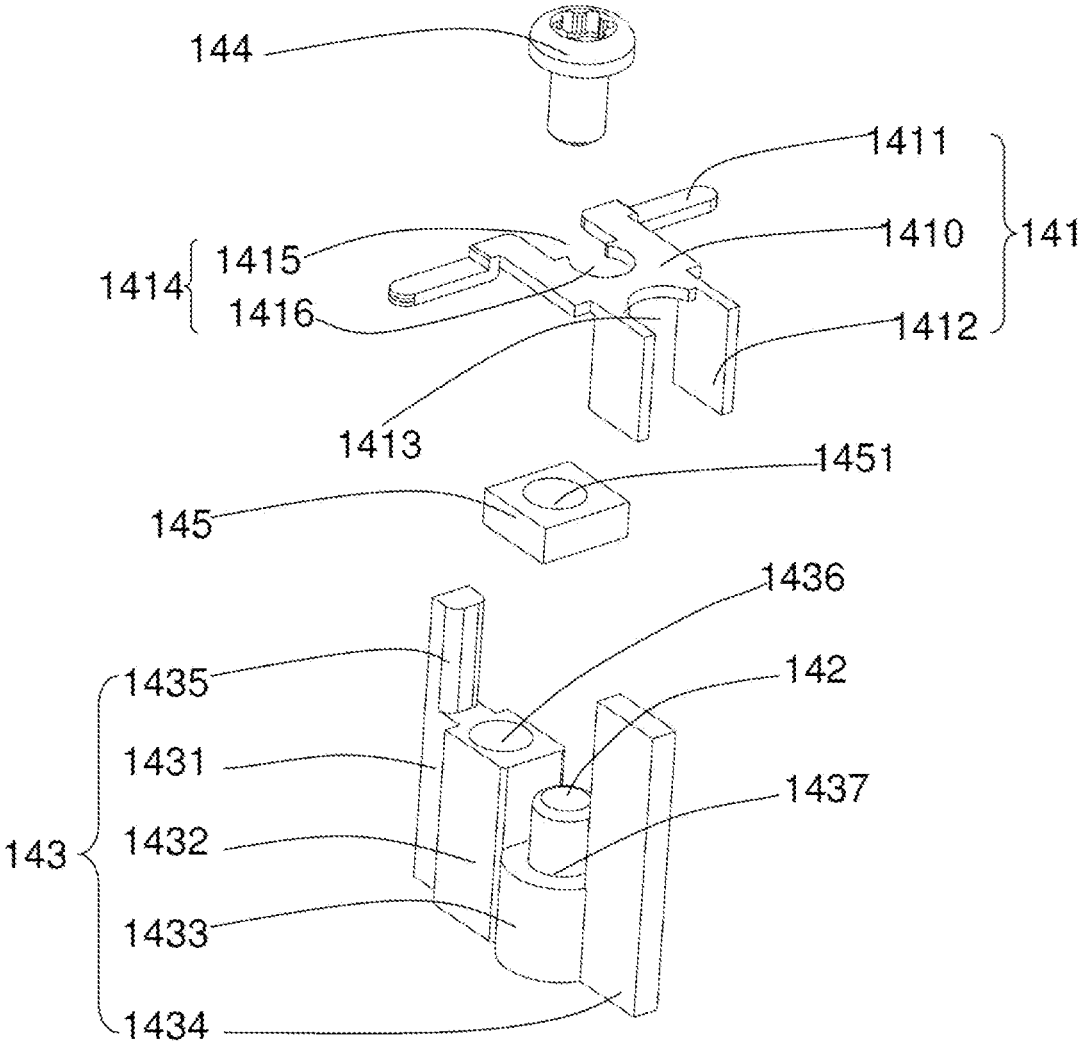
FIG. 3 is an exploded perspective view of a coupling adjustment assembly of the cavity filter shown in FIG. 1.

FIG. 3 shows an exploded view of the coupling adjustment assembly 140 of FIG. 1. Referring to FIG. 3, the electrical coupling sheet 141 includes a bottom plate 1410, two symmetrical extension arms 1411 and two symmetrical flakes 1412 extended from the sides of the bottom plate 1410 respectively. The bottom plate 1410 has a first opening 1413 and a second opening 1414. The second opening 1414 includes a third opening 1415 for positioning and a fourth opening 1416 for locking, the third opening 1415 is in communication with the fourth opening 1416. Two symmetrical flakes 1412 are provided on two sides of the first opening 1413, and two symmetrical extension arms 1411 are provided on two sides of the second opening 1414 respectively. The two symmetrical flakes 1412 are disposed perpendicularly to the bottom plate 1410, and the two symmetrical extension arms 1411 are disposed in parallel with the bottom plate 1410. The partition wall 143 includes a first partition plate 1431, a first fixing base 1432, a second fixing base 1433, and a second partition plate 1434. The first fixing base 1432 and the second fixing base 1433 are provided in a step structure, and the first fixing base 1432 is higher than the second fixing base 1433. The first partition plate 1431 has a positioning post 1435 that has the same height as the second partition plate 1434. The coupling adjustment screw 142 is installed with the second fixing base 1433 by the threaded hole 1437. The length of the coupling adjustment screw 142 protruding from the second fixing base 1433 can be adjusted, and the first fixing base 1432 is provided with a threaded hole 1436 which engages with the fastener 144.

When the coupling adjustment assembly 140 is assembled, the gasket 145 is placed on the first fixing base 1432. The third opening 1415 of the electrical coupling sheet 141 is buckled into the positioning post 1435 and the bottom plate 1410 is placed on the gasket 145. The fastener 144 is successively passed through the fourth opening 1416 and the gasket through hole 1451 and engaged with the threaded hole 1436 to secure the electrical coupling sheet 141 and the partition wall 143 together. After assembly is completed, the coupling adjustment screw 142 is located between the two flakes 1412 and is located below the first opening 1413. In the embodiment, the fastener 144 is a screw. The fastener 144 and the gasket 145 include insulating materials such as plastic, rubber, ceramic, etc.

Figure 4:
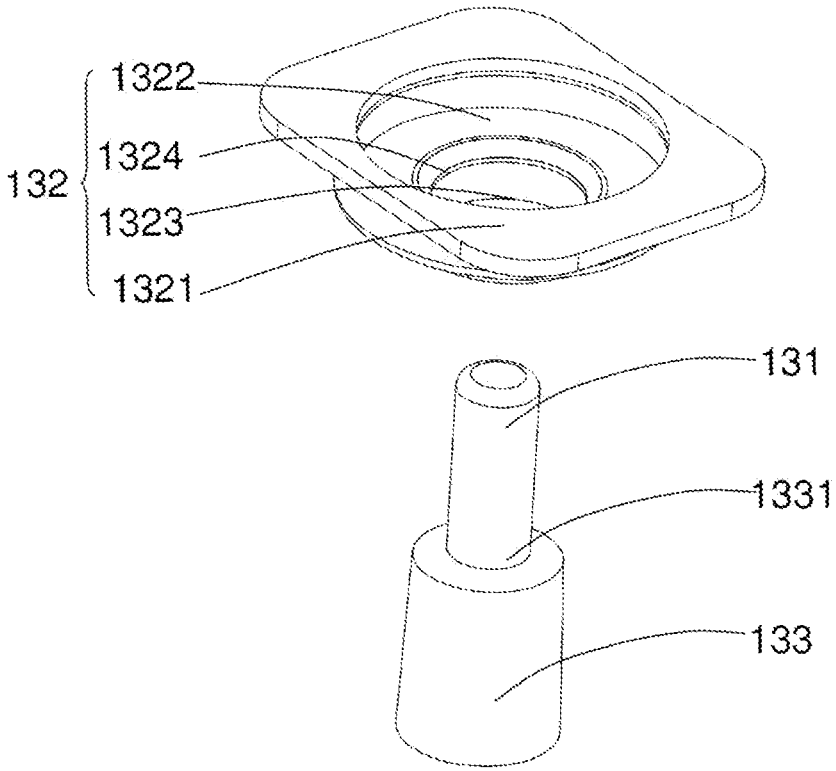
FIG. 4 is an exploded perspective view of a resonating assembly of the cavity filter shown in FIG. 1.
Figure 5:
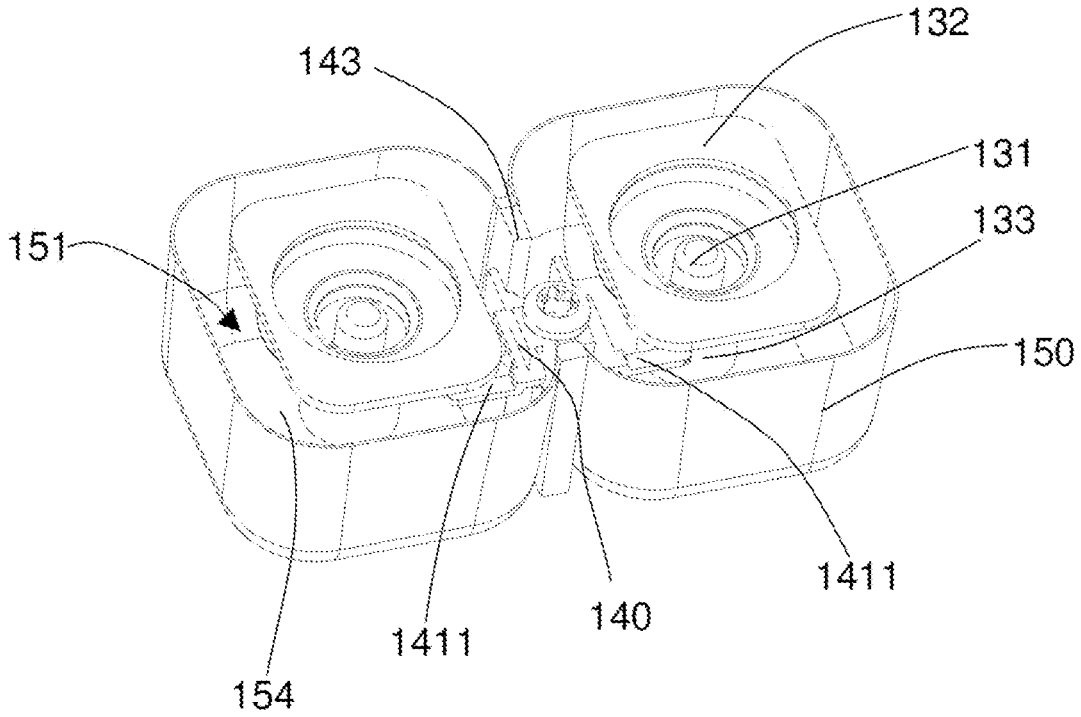
FIG. 5 is an assembled perspective view of FIG. 1 after removing the cover plate.

FIG. 4 shows an exploded view of a resonating assembly 130 of FIG. 1. In FIG. 4, the resonant cap 132 includes a cap body 1321, a concave portion 1322 in the middle of the cap body 1321, and a through hole 1323 in the concave portion 1322. The through hole 1323 is provided with a step 1324. The cap body 1321 has a substantially rectangular corners. The resonant tube 133 is provided with a threaded hole 1331, and the resonant adjustment screw 131 is adjustably mounted in the threaded hole 1331.

When the resonant assembly 130 is assembled, the resonant tube 133 is passed through the through hole 1323 and engaged with the step 1324. The resonant tube 133 and the through hole 1323 are in an interference fit to secure the resonant tube 133 to the resonant cap 132. The resonant adjustment screw 131 is passed through the through hole 1323 and is freely to stretched from the through hole 1323. In other embodiments, the resonant cap 132 is welded with the resonant tube 133.

Referring to FIGS. 1, 3, 4 and 5, when the housing 150 and the cover plate 110 are mounted together, the two capacitive loading rings 120 mounted on the cover plate 110 respectively extend into the concave portion 1322 of the two resonant cap 132 without contacting with the concave portion 1322, and respectively forms a load capacitance on both of two symmetrical resonant cavities 151. The frequency of the cavity filter 100 is debugged by the resonant adjustment screw 131 provided on the resonant tube 133. The positioning post 1435 of the coupling adjustment assembly 140 and the second partition plate 1434 are each in contact with the inner surface of the cover plate 110. The coupling adjustment screw 142 is extended from the bottom of the housing 150 and mounted on the second fixing base 1433. The two extension arms 1411 of the electrical coupling sheet 141 are respectively inserted under the two resonant cap 132 so as to form a capacitance with the resonant cap 132, and the length of the coupling fixing screw 142 protruding from the second fixing base 1433 is adjustable. The length of the coupling fixing screw 142 protruding from the second fixing base 1433 adjusts the ground capacitance of the electrical coupling sheet 141. When the length of coupling fixing screw 142 is adjusted, the amount of electrical coupling between the two resonant cavities 151 is changed. The present application provides a coupling adjustment assembly 140 between the two resonant cavities 151 of the cavity filter 100 to effectively reduce the magnetic coupling between the two resonant cavities 151 while enhancing the electrical coupling amount.

Figure 6:
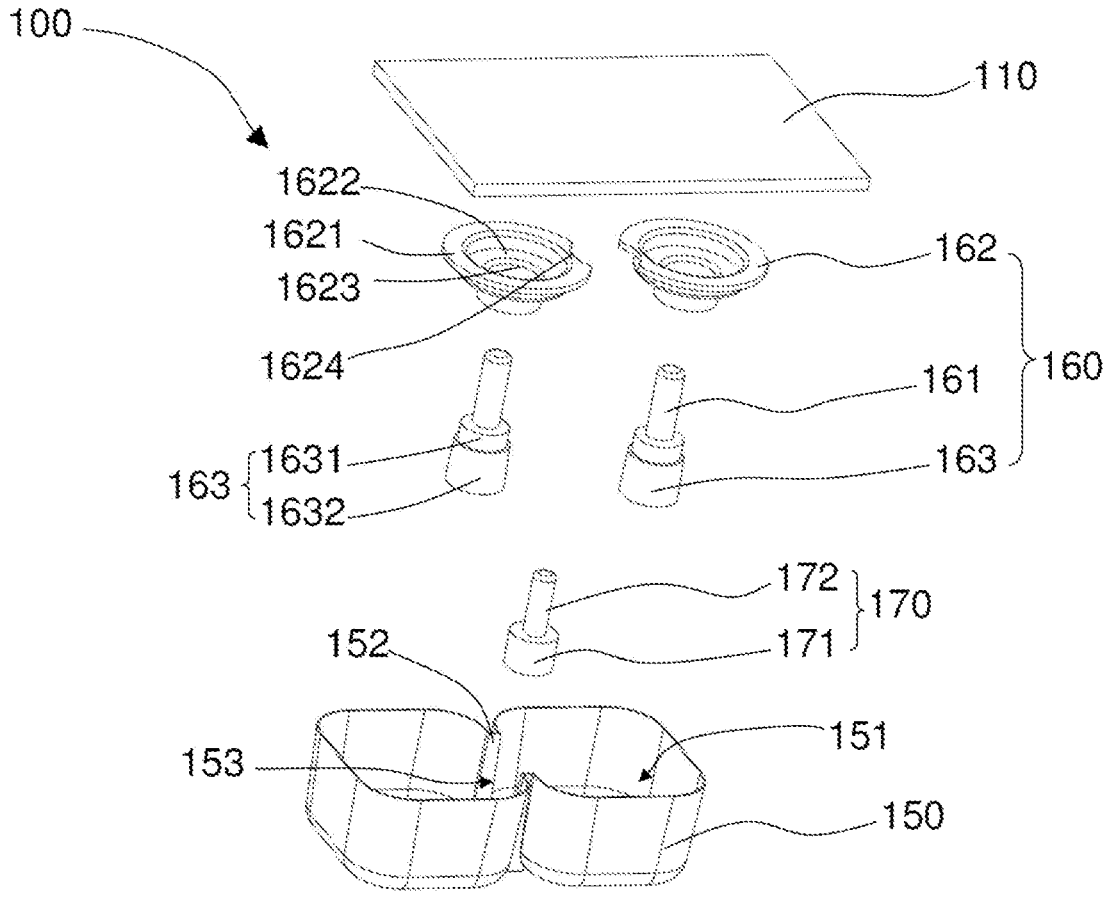
FIG. 6 is an exploded perspective view of another exemplary embodiment of a cavity filter.

FIG. 6 shows an another exemplary embodiment of a cavity filter 100. The cavity filter 100 includes a cover plate 110, a resonating assembly 160, a coupling adjustment assembly 170, and a housing 150. The resonating assembly 160 includes a resonant adjustment screw 161, a resonant cap 162 and a resonant tube 163. The resonant cap 162 is coiled around the resonant tube 163. The resonant adjustment screw 161 is mounted on the resonant tube 163 by a threaded structure. The coupling adjustment assembly 170 includes a third fixing base 171 and a coupling adjustment screw 172 mounted on the third fixing base 171 by a threaded structure on the third fixing base 171. As such the coupling adjustment screw 172 is adjustable. The third fixing base 171 is mounted on the bottom of the adjustment passage 153, and the resonant tube 163 is mounted on the bottom wall 154 of the housing 150 (see FIG. 2). The cover plate 110 covers the housing 150 to enclose the resonant cavities 151.

Figure 7:
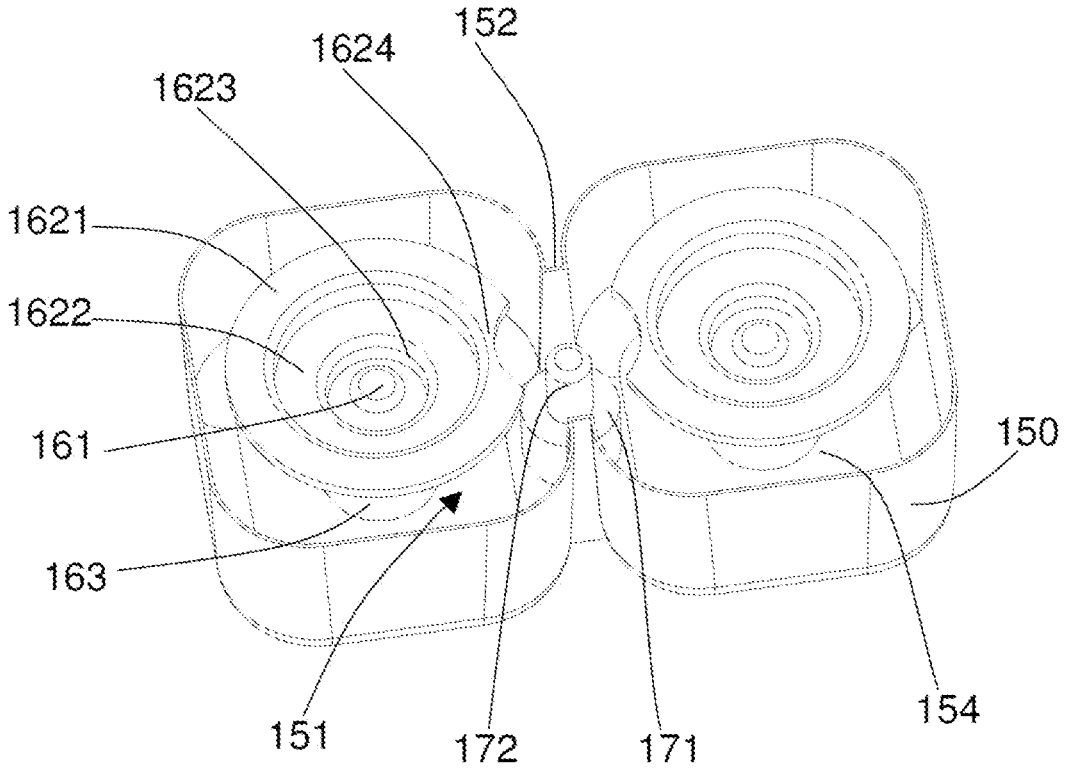
FIG. 7 is an assembled perspective view of FIG. 6 after removing the cover plate.

Referring to FIGS. 6 and 7, in the present exemplary embodiment, the resonant cap 162 includes a cap body 1621, a concave portion 1622 on the middle of the cap body 1621, and a through hole 1623 provided in the concave portion 1622. The cap body 1621 is generally circular and has a notch 1624 at one side edge thereof. The resonant tube 163 generally has a substantially downwardly stepped columnar shape comprising a fixing column 1632 and a connecting column 1631. The connecting column 1631 is smaller than the fixing column 1632. The fixing post 1632 is fixed to the bottom wall 154 of the housing 150 (see FIG. 2). The connecting column 1631 is passed through the through hole 1623 and is in interference with the through hole 1623. The resonant tube 163 is fastened together with the resonant cap 162. The resonant adjustment screw 161 is passed through the through hole 1623 and is freely adjustable. The third fixing base 171 is provided at the middle of the bottom of the adjustment passage 153. The coupling adjustment screw 172 extends from the third fixing base 171 into the adjustment passage 153. Preferably, the bottom of the third fixing base 171 is embedded into the bottom of the adjustment passage 153, and the resonant tube 163 and the third fixing base 171 are provided with threaded holes (not shown) penetrating through the bottom of the housing 150. The resonant adjustment screw 161 and the coupling adjustment screw 172 are screwed into the resonant tube 163 and the third fixing base 171 from the bottom of the housing 150. In other embodiments, the location of the bottom of the housing 150 with the resonant tube 163 and the third fixing base 171 can be a recessed structure, but the other locations of the bottom of the housing 150 can be planar. So that the threaded holes of the resonant tube 163 and the third fixing base 171 are exposed in the recessed structure, and it is convenient to install the resonant adjustment screw 161 and the coupling adjustment screw 172 separately to the resonant tube 163 and the third fixing base 171.

The notches 1624 of the two resonance caps 162 are arranged symmetrically about the coupling adjustment screw 172. The notch 1624 is arc-shaped. The arc center of the notch 1624 is in the axial direction of the coupling adjustment screw 172. In the embodiment, the resonance frequency of the single resonant cavity 151 is changed by only one percent by setting the cap body 1621 of the resonant cap 162 into a circular shape and providing a notch 1624 on edge of the resonant cap 162, while the coupling band width is almost doubled to facilitate the production of the cavity filter 100. Thus it is convenient to adjust the return loss and the bandwidth of the cavity filter 100 to the specified range. For a filter using a circular resonant cap 162, the coupling adjustment screw 161 can only mobilize 5.5 MHz in a stroke range of 6 mm, but the coupling bandwidth can be increased to 10 MHz, while the resonant frequency of the single resonant cavity 151 rises from 2170 MHz To 2190 MHz, an increase only about 1% (20 MHz). Such variables can be adjusted by adjusting the adjustment screw 161 or modify the size of resonant cavity or other components to overcome the increase of the resonant frequency.

In summary, in the cavity filter 100 of the present application, the resonating assembly 130 and 160, and the coupling adjustment components 140 and 170 are embedded into the bottom of the housing 150, such that the outer surface of the housing 150 has no exposed adjustment structure. The bottom of the housing 150 is kept flat so as to reduce the size of the cavity filter 100 and easy to adjust. The cover plate 110 provides without any adjustment structure to reduce the thickness of the cover plate, with small size, less material and low cost. The frequency debugging range of the coupling adjustment screws 142 and 172 can be increased by changing the shape of the resonance cap 162 and the provision of the electrical coupling sheet 141 to improve the performance of the cavity filter 100.

The exemplary embodiments shown and described above are only examples. Many details are often found in the art such as the features of cavity filter and cover mechanism thereof. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A cavity filter, comprising:

a housing comprising a plurality of resonant cavity groups formed in the housing, and each of the plurality of resonant cavity groups having two resonant cavities;

a partitioning portion disposed between the two resonant cavities of each of the plurality of resonator cavity groups, and the partitioning portion having an adjustment passage running through the two resonant cavities of each of the plurality of resonator cavity groups;

a cover plate coupled to the housing, for covering the plurality of resonant cavity groups;

a resonating assembly comprising a resonant tube mounted on an inner wall of at least one of the two resonant cavities of each of the plurality of resonator cavity groups, and a resonant cap connected with the resonant tube;

a resonant adjustment screw mounted in the resonant tube, and the resonant cap opposite to the cover plate; and a coupling adjustment assembly for reducing the magnetic coupling amount between the two resonant cavities of each of the plurality of resonator cavity groups and enhancing the electrical coupling amount between the two resonant cavities of each of the plurality of resonator cavity groups, the coupling adjustment assembly comprising a coupling fixing structure mounted on the partitioning portion and a coupling adjustment structure mounted on the coupling fixing structure, the coupling adjustment structure extending out from the adjustment passage, wherein the coupling fixing structure comprises a third fixing base mounted on the partitioning portion, the coupling adjustment structure comprises a coupling adjustment screw with one end mounted on the third fixing base, and another end of the coupling adjustment screw is located in the adjustment passage and extended out from the third fixing base, the resonant cap with a notch adjacent to the coupling adjustment screw, and the notch is relative to the coupling adjustment screw.

2. The cavity filter of claim 1, wherein the resonant cap is generally circular, the notch is arc-shaped, and an arc center of the notch is in the axial direction of the coupling adjustment screw.

3. A cavity filter, comprising:

a housing comprising a plurality of resonant cavity groups formed in the housing, and each of the plurality of resonant cavity groups having two resonant cavities;

a partitioning portion disposed between the two resonant cavities of each of the plurality of resonator cavity groups, and the partitioning portion having an adjustment passage running through the two resonant cavities of each of the plurality of resonator cavity groups;

a cover plate coupled to the housing, for covering the plurality of resonant cavity groups;

a resonating assembly comprising a resonant tube mounted on an inner wall of at least one of the two resonant cavities of each of the plurality of resonator cavity groups, and a resonant cap connected with the resonant tube, wherein the resonant cap has a concave portion;

a resonant adjustment screw mounted in the resonant tube, and the resonant cap opposite to the cover plate;

a coupling adjustment assembly for reducing the magnetic coupling amount between the two resonant cavities of each of the plurality of resonator cavity groups and enhancing the electrical coupling amount between the two resonant cavities of each of the plurality of resonator cavity groups, the coupling adjustment assembly comprising a coupling fixing structure mounted on the partitioning portion and a coupling adjustment structure mounted on the coupling fixing structure, the coupling adjustment structure extending out from the adjustment passage; and a capacitive loading ring, wherein the capacitive loading ring is mounted on the cover plate and is protruded into the concave portion.

4. A cavity filter, comprising:

a housing comprising a plurality of resonant cavity groups formed in the housing, and each of the plurality of resonant cavity groups having two resonant cavities;

a partitioning portion disposed between the two resonant cavities of each of the plurality of resonator cavity groups, and the partitioning portion having an adjustment passage running through the two resonant cavities of each of the plurality of resonator cavity groups;

a cover plate coupled to the housing, for covering the plurality of resonant cavity groups;

a resonating assembly comprising a resonant tube mounted on an inner wall of at least one of the two resonant cavities of each of the plurality of resonator cavity groups, and a resonant cap connected with the resonant tube;

a resonant adjustment screw mounted in the resonant tube, and the resonant cap opposite to the cover plate; and a coupling adjustment assembly for reducing the magnetic coupling amount between the two resonant cavities of each of the plurality of resonator cavity groups and enhancing the electrical coupling amount between the two resonant cavities of each of the plurality of resonator cavity groups, the coupling adjustment assembly comprising a coupling fixing structure mounted on the partitioning portion and a coupling adjustment structure mounted on the coupling fixing structure, the coupling adjustment structure extending out from the adjustment passage, wherein the coupling fixing structure comprises a partition wall mounted on the partitioning portion, and the coupling adjustment structure comprises a coupling adjustment screw and an electrical coupling sheet.

5. The cavity filter of claim 4, wherein the electrical coupling sheet is fastened on the first fixing base by a fastener, and a gasket is disposed between the electrical coupling sheet and the first fixing base, the fastener and the gasket are made of insulating material.

6. The cavity filter of claim 4, wherein the electrical coupling sheet comprises a bottom plate, two symmetrical extension arms and two symmetrical flakes extended from a side of the bottom plate, and the two symmetrical extension arms separately extend into the two resonant cavities and respectively extends below the resonant cap to form a capacitance with the resonant cap, and the coupling adjustment screw extends from one end of the second fixing base and is located between the two symmetrical flakes.

7. The cavity filter of claim 6, wherein the bottom plate is provided with a first opening and a second opening opposed to the first opening, the two symmetrical flakes are located on two sides of the first opening, and the two symmetrical extension arms are located on two sides of the second opening, and the two symmetrical flakes are perpendicular to the bottom plate, and the two symmetrical extension arms are parallel to the bottom plate.

8. The cavity filter of claim 4, wherein the partition wall comprises a first fixing base and a second fixing base, the electrical coupling sheet is mounted on the first fixing base, one end of the coupling adjustment screw is mounted on the second fixing base, and another end of the coupling adjustment screw is extended from the second fixing base and located in the adjustment passage.

9. The cavity filter of claim 8, wherein the partition wall further comprises a first partition plate and a second partition plate, the first partition plate, the first fixing base, the second fixing base and the second partition plate are connected in series, the first fixing base and the second fixing base are stepped structures, and the first fixing base is higher than the second fixing base.

10. The cavity filter of claim 9, wherein the first partition plate has a positioning post that has the same height as the second fixing base, and the first partition plate and the second fixing base are in contact with the cover plate.

11. The cavity filter of claim 9, wherein a bottom of the partition wall is embedded in the housing, the coupling adjustment screw runs through a bottom of the housing and is mounted on the second fixing base through a threaded structure, and when the coupling adjustment screw is rotated in different directions, a length of the coupling adjustment screw extending out of the second fixing base is changed, and the electric coupling amount between the two resonant cavities is adjusted.

* * * * *